US006846175B2

(12) United States Patent
Spicer

(10) Patent No.: US 6,846,175 B2
(45) Date of Patent: Jan. 25, 2005

(54) BURNER EMPLOYING FLUE-GAS RECIRCULATION SYSTEM

(75) Inventor: David B. Spicer, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 130 days.

(21) Appl. No.: 10/389,007

(22) Filed: Mar. 14, 2003

(65) Prior Publication Data

US 2003/0175639 A1 Sep. 18, 2003

Related U.S. Application Data

(60) Provisional application No. 60/365,150, filed on Mar. 16, 2002.

(51) Int. Cl.[7] ..... F23M 3/00

(52) U.S. Cl. ..... 431/9; 431/5; 431/115; 126/91 A

(58) Field of Search ..... 431/5, 9, 115, 431/215; 126/91 A

(56) References Cited

U.S. PATENT DOCUMENTS

| | | | |
|---|---|---|---|
| 2,368,370 | A | 1/1945 | Maxon |
| 2,813,578 | A | 11/1957 | Ferguson |
| 2,918,117 | A | 12/1959 | Griffin |
| 2,983,312 | A | 5/1961 | Finley et al. |

(List continued on next page.)

FOREIGN PATENT DOCUMENTS

| | | |
|---|---|---|
| CA | 1169753 | 6/1984 |
| DE | 2944153 | 5/1981 |
| DE | 3232421 | 3/1984 |
| DE | 3818265 | 11/1989 |
| EP | 0099828 | 6/1988 |

(List continued on next page.)

OTHER PUBLICATIONS

Straitz III, John F., et al., "Combat NOx With Better Burner Design," *Chemical Engineering*, Nov. 1994, pp. EE–4–EE–8.

Vahdati, M. M., et al., "Design And Development of A Low NOx Coanda Ejector Burner," *Journal of the Institute of Energy*, Mar. 2000, vol. 73, pp. 12–17.

Bussman, Wes, et al., "Low NOx Burner Technology for Ethylene Cracking Furnaces," presented at the *2001 AIChE Spring National Meeting, 13th Annual Ethylene Producers Conference*, Houston, TX, Apr. 25, 2001, pp. 1–23.

Seebold, James G., "Reduce Heater NOx in the Burner," *Hydrocarbon Processing*, Nov. 1982, pp. 183–186.

"West Germany's Caloric Develops a Low–NOx Recycling Fuel Burner," *Chemical Engineering*, Oct. 4, 1982, p. 17.

Chemical Engineering Progress, vol. 43, 1947, "The Design of Jet Pumps" by A. Edgar Kroll, pp. 21–24, vol. 1, No. 2.

*Primary Examiner*—Alfred Basichas

(74) *Attorney, Agent, or Firm*—Lucinda Lomas; Linda A. Kubena

(57) ABSTRACT

A method and apparatus for reducing the temperature of the recirculated flue gas in a flue gas recirculation duct for burners in industrial furnaces such as those used in steam cracking. The apparatus includes a burner tube having a downstream end and an upstream end for receiving air, flue gas and fuel gas, a burner tip mounted on the downstream end of the burner tube adjacent a first opening in the furnace, so that combustion of the fuel takes place downstream of the burner tip; at least one passageway having a first end at a second opening in the furnace and a second end adjacent the upstream end of the burner tube, the passageway having an orifice in fluid communication with a source of air which is cooler than the flue gas; and a mechanism for drawing flue gas from the furnace through the passageway and air from the orifice of the passageway in response to an inspirating effect created by uncombusted fuel flowing through the burner tube from its upstream end towards its downstream end, whereby the flue gas is mixed with air from the orifice of the passageway prior to the zone of combustion of the fuel to thereby lower the temperature of the drawn flue gas.

27 Claims, 9 Drawing Sheets

U.S. PATENT DOCUMENTS 3,880,570 A 4/1975 Marshall
4,004,875 A 1/1977 Zink et al.
4,089,629 A 5/1978 Baumgartner et al.
4,130,388 A 12/1978 Flanagan
4,230,445 A 10/1980 Janssen
4,257,763 A 3/1981 Reed
4,575,332 A 3/1986 Oppenberg et al.
4,629,413 A 12/1986 Michelson et al.
4,708,638 A 11/1987 Brazier et al.
4,739,713 A 4/1988 Vier et al.
4,748,919 A 6/1988 Campobenedetto et al.
4,815,966 A 3/1989 Janssen
4,828,483 A 5/1989 Finke
4,963,089 A 10/1990 Spielman
4,995,807 A 2/1991 Rampley et al.
5,044,931 A 9/1991 Van Eerden et al.
5,073,105 A 12/1991 Martin et al.
5,092,761 A 3/1992 Dinicolantonio
5,098,282 A 3/1992 Schwartz et al.
5,135,387 A 8/1992 Martin et al.
5,152,463 A 10/1992 Mao et al.
5,154,596 A 10/1992 Schwartz et al.
5,195,884 A 3/1993 Schwartz et al.
5,201,650 A 4/1993 Johnson
5,224,851 A 7/1993 Johnson
5,238,395 A 8/1993 Schwartz et al.
5,254,325 A * 10/1993 Yamasaki et al. ..... 423/450
5,263,849 A 11/1993 Irwin et al.
5,269,679 A 12/1993 Syska et al.
5,275,554 A 1/1994 Faulkner
5,284,438 A 2/1994 McGill et al.
5,299,930 A 4/1994 Weidman
5,316,469 A 5/1994 Martin et al.
5,326,254 A 7/1994 Munk
5,344,307 A 9/1994 Schwartz et al.
5,350,293 A 9/1994 Khinkis et al.
5,370,526 A 12/1994 Buschulte et al.
5,407,345 A 4/1995 Robertson et al.
5,413,477 A 5/1995 Moreland
5,470,224 A 11/1995 Bortz
5,472,341 A 12/1995 Meeks
5,542,839 A 8/1996 Kelly
5,562,438 A 10/1996 Gordon et al.
5,584,684 A 12/1996 Dobbeling et al.
5,603,906 A 2/1997 Lang et al.
5,611,682 A 3/1997 Slavejkov et al.
5,624,253 A 4/1997 Sulzhik et al.
5,685,707 A * 11/1997 Ramsdell et al. ..... 431/90
5,688,115 A * 11/1997 Johnson ..... 431/9
5,807,094 A 9/1998 Sarv
5,813,846 A * 9/1998 Newby et al. ..... 431/9
5,980,243 A 11/1999 Surbey et al.
5,984,665 A 11/1999 Loftus et al.
5,987,875 A 11/1999 Hilburn et al.
5,993,193 A 11/1999 Loftus et al.
6,007,325 A 12/1999 Loftus et al.
6,056,538 A 5/2000 Büchner et al.
6,332,408 B2 * 12/2001 Howlett et al. ..... 110/189
6,347,935 B1 2/2002 Schindler et al.
6,383,462 B1 * 5/2002 Lang ..... 423/235
6,616,442 B2 9/2003 Venizelos et al.

FOREIGN PATENT DOCUMENTS

EP 0 347 956 12/1989
EP 0 374 423 6/1990
EP 0 408 171 A1 1/1991
EP 0 620 402 A1 10/1994
EP 0 674 135 B2 9/1995
EP 0 751 343 1/1997
EP 0486169 1/1998
EP 1096202 2/2001
FR 2629900 10/1988
RU 374488 5/1970

* cited by examiner

BURNER EMPLOYING FLUE-GAS RECIRCULATION SYSTEM

RELATED APPLICATIONS

This patent application claims priority from Provisional Application Ser. No. 60/365,150, filed on Mar. 16, 2002, the contents of which are hereby incorporated by reference.

FIELD OF THE INVENTION

This invention relates to an improvement in a burner such as those employed in high temperature furnaces in the steam cracking of hydrocarbons. More particularly, it relates to the use of a burner of novel configuration to reduce the temperature of recirculated flue gas.

BACKGROUND OF THE INVENTION

As a result of the interest in recent years to reduce the emission of pollutants from burners used in large industrial furnaces, burner design has undergone substantial change. In the past, improvements in burner design were aimed primarily at improving heat distribution. Increasingly stringent environmental regulations have shifted the focus of burner design to the minimization of regulated pollutants.

Oxides of nitrogen ($NO_x$) are formed in air at high temperatures. These compounds include, but are not limited to, nitrogen oxide and nitrogen dioxide. Reduction of $NO_x$ emissions is a desired goal to decrease air pollution and meet government regulations. In recent years, a wide variety of mobile and stationary sources of $NO_x$ emissions have come under increased scrutiny and regulation.

A strategy for achieving lower $NO_x$ emission levels is to install a $NO_x$ reduction catalyst to treat the furnace exhaust stream. This strategy, known as Selective Catalytic Reduction (SCR), is very costly and, although it can be effective in meeting more stringent regulations, represents a less desirable alternative to improvements in burner design.

Burners used in large industrial furnaces may use either liquid fuel or gas. Liquid fuel burners mix the fuel with steam prior to combustion to atomize the fuel to enable more complete combustion, and combustion air is mixed with the fuel at the zone of combustion.

Gas fired burners can be classified as either premix or raw gas, depending on the method used to combine the air and fuel. They also differ in configuration and the type of burner tip used.

Raw gas burners inject fuel directly into the air stream, and the mixing of fuel and air occurs simultaneously with combustion. Since airflow does not change appreciably with fuel flow, the air register settings of natural draft burners must be changed after firing rate changes. Therefore, frequent adjustment may be necessary, as explained in detail in U.S. Pat. No. 4,257,763. In addition, many raw gas burners produce luminous flames.

Premix burners mix some or all of the fuel with some or all of the combustion air prior to combustion. Since premixing is accomplished by using the energy present in the fuel stream, airflow is largely proportional to fuel flow. As a result, therefore, less frequent adjustment is required. Premixing the fuel and air also facilitates the achievement of the desired flame characteristics. Due to these properties, premix burners are often compatible with various steam cracking furnace configurations.

Floor-fired premix burners are used in many steam crackers and steam reformers primarily because of their ability to produce a relatively uniform heat distribution profile in the tall radiant sections of these furnaces. Flames are non-luminous, permitting tube metal temperatures to be readily monitored. Therefore, a premix burner is the burner of choice for such furnaces. Premix burners can also be designed for special heat distribution profiles or flame shapes required in other types of furnaces.

One technique for reducing $NO_x$ that has become widely accepted in industry is known as combustion staging. With combustion staging, the primary flame zone is deficient in either air (fuel-rich) or fuel (fuel-lean). The balance of the air or fuel is injected into the burner in a secondary flame zone or elsewhere in the combustion chamber. As is well known, a fuel-rich or fuel-lean combustion zone is less conducive to $NO_x$ formation than an air-fuel ration closer to stoichiometry. Combustion staging results in reducing peak temperatures in the primary flame zone and has been found to alter combustion speed in a way that reduces $NO_x$. Since $NO_x$ formation is exponentially dependent on gas temperature, even small reductions in peak flame temperature dramatically reduce $NO_x$ emissions. However this must be balanced with the fact that radiant heat transfer decreases with reduced flame temperature, while CO emissions, an indication of incomplete combustion, may actually increase as well.

In the context of premix burners, the term primary air refers to the air premixed with the fuel; secondary, and in some cases tertiary, air refers to the balance of the air required for proper combustion. In raw gas burners, primary air is the air that is more closely associated with the fuel; secondary and tertiary air are more remotely associated with the fuel. The upper limit of flammability refers to the mixture containing the maximum fuel concentration (fuel-rich) through which a flame can propagate.

U.S. Pat. No. 4,004,875, the contents of which are incorporated by reference in their entirety, discloses a low $NO_x$ burner, in which combusted fuel and air is cooled and recirculated back into the combustion zone. The recirculated combusted fuel and air is formed in a zone with a deficiency of air.

U.S. Pat. No. 4,629,413 discloses a low $NO_x$ premix burner and discusses the advantages of premix burners and methods to reduce $NO_x$ emissions. The premix burner of U.S. Pat. No. 4,629,413 lowers $NO_x$ emissions by delaying the mixing of secondary air with the flame and allowing some cooled flue gas to recirculate with the secondary air. The contents of U.S. Pat. No. 4,629,413 are incorporated by reference in their entirety.

U.S. Pat. No. 5,092,761 discloses a method and apparatus for reducing $NO_x$ emissions from premix burners by recirculating flue gas. Flue gas is drawn from the furnace through a pipe or pipes by the inspirating effect of fuel gas and combustion air passing through a venturi portion of a burner tube. The flue gas mixes with combustion air in a primary air chamber prior to combustion to dilute the concentration of $O_2$ in the combustion air, which lowers flame temperature and thereby reduces $NO_x$ emissions. The flue gas recirculating system may be retrofitted into existing premix burners or may be incorporated in new low $NO_x$ burners. The contents of U.S. Pat. No. 5,092,761 are incorporated by reference in their entirety.

A drawback of the system of U.S. Pat. No. 5,092,761 is that the staged-air used to cool the FGR duct must first enter the furnace firebox, traverse a short distance across the floor, and then enter the FGR duct. During this passage, the staged air is exposed to radiation from the hot flue gas in the firebox. Analyses of experimental data from burner tests suggest that the staged-air may be as hot as 700° F. when it enters the FGR duct.

Despite these advances in the art, a need exists for a burner having a desirable heat distribution profile that meets increasingly stringent $NO_x$ emission regulations and results in acceptable FGR duct temperatures.

Therefore, what is needed is a burner for the combustion of fuel gas and air wherein the temperature of the fuel/air/flue-gas mixture is advantageously reduced and which also enables higher flue gas recirculation ratios (FGR) to be utilized in order to meet stringent emissions regulations. The required burner will provide extended FGR duct life as a result of the lower temperature of the recirculated gas.

SUMMARY OF THE INVENTION

The present invention is directed to a method and apparatus for reducing the temperature of recirculated flue gas in a flue gas recirculation duct for use in burners of furnaces such as those used in steam cracking. The apparatus includes a burner tube having a downstream end, and having an upstream end for receiving air, flue gas and fuel gas, a burner tip mounted on the downstream end of said burner tube adjacent to a first opening in the furnace, so that combustion of the fuel takes place downstream of the burner tip, at least one passageway having a first end at a second opening in the furnace and a second end adjacent the upstream end of the burner tube, the passageway having an orifice; at least one bleed air duct having a first end and a second end, the first end in fluid communication with the orifice of the at least one passageway and the second end in fluid communication with a source of air which is cooler than the flue gas, and means for drawing flue gas from the furnace through the at least one passageway and air from the at least one bleed air duct through said at least one passageway in response to an inspirating effect created by uncombusted fuel flowing through the burner tube from its upstream end towards its downstream end, whereby the flue gas is mixed with air from the air bleed duct prior to the zone of combustion of the fuel to thereby lower the temperature of the drawn flue gas.

The method of the present invention includes the steps of combining fuel, air and flue gas at a predetermined location, combusting the fuel at a combustion zone downstream of said predetermined location, drawing a stream of flue gas from the furnace in response to the inspirating effect of uncombusted fuel flowing towards the combustion zone; and mixing air drawn from a duct, the air having a temperature lower than the temperature of the flue gas, with the stream of flue gas so drawn and drawing the mixture of the lower temperature air and flue gas to the predetermined location to thereby lower the temperature of the drawn flue gas.

An object of the present invention is to provide a burner arrangement that permits the temperature of the air and flue gas mixture in the FGR duct to be reduced, thus prolonging the life of the FGR duct. Alternatively, the arrangement permits the use of higher FGR ratios at constant venturi temperature.

These and other objects and features of the present invention will be apparent from the detailed description taken with reference to accompanying drawings.

BRIEF DESCRIPTION OF THE DRAWINGS

The invention is further explained in the description that follows with reference to the drawings illustrating, by way of non-limiting examples, various embodiments of the invention wherein.

DETAILED DESCRIPTION OF THE ILLUSTRATED EMBODIMENTS

Figure 1:
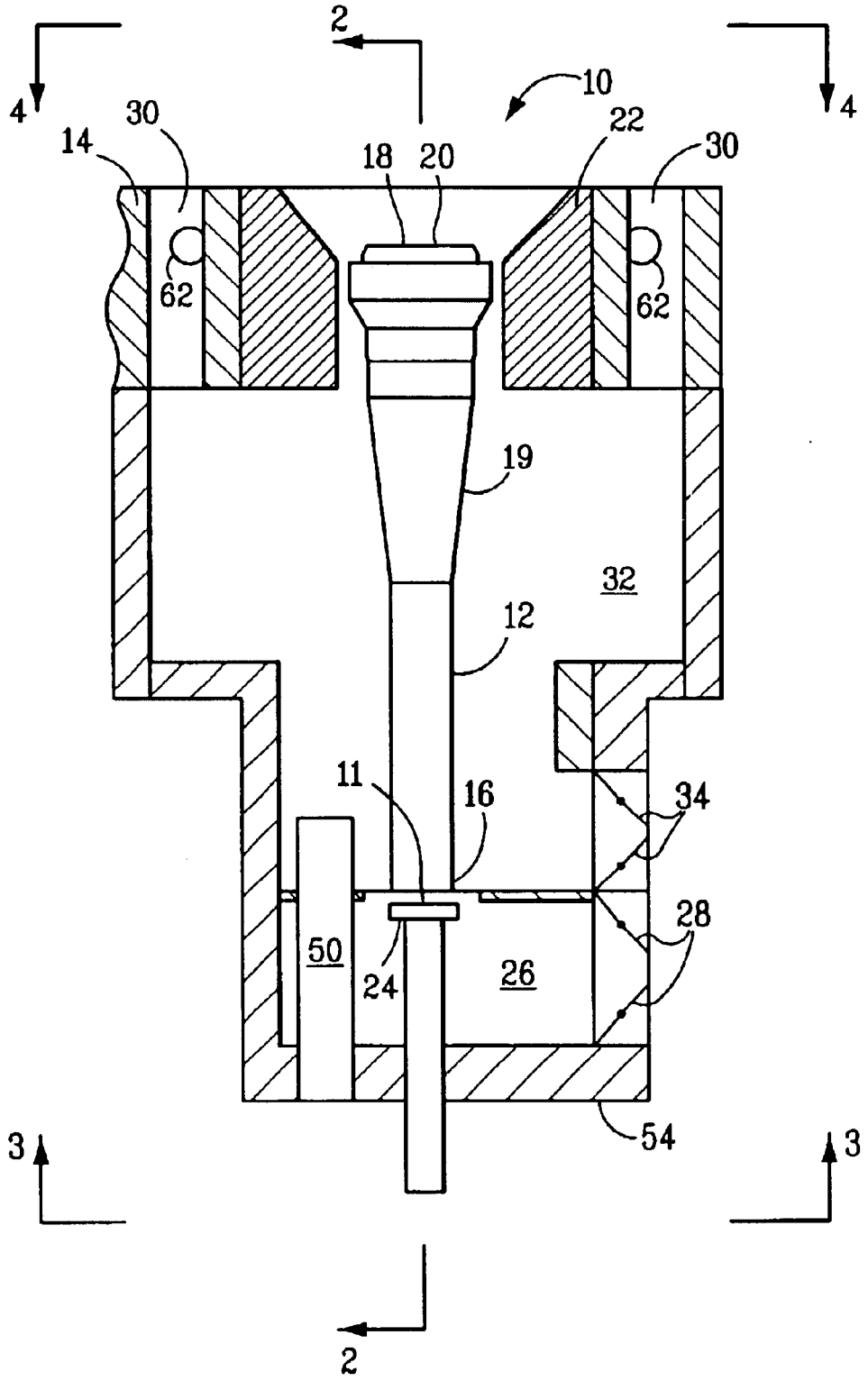
FIG. 1 illustrates an elevation partly in section of an embodiment of the premix burner of the present invention.

Reference is now made to the embodiments illustrated in FIGS. 1–10 wherein like numerals are used to designate like parts throughout.

Although the present invention is described in terms of a burner for use in connection with a furnace or an industrial furnace, it will be apparent to one of skill in the art that the teachings of the present invention also have applicability to other process components such as, for example, boilers. Thus, the term furnace herein shall be understood to mean furnaces, boilers and other applicable process components.

Referring now to FIGS. 1–4, a premix burner 10 includes a freestanding burner tube 12 located in a well in a furnace floor 14. Burner tube 12 includes an upstream end 16, a downstream end 18 and a venturi portion 19. Burner tip 20 is located at downstream end 18 and is surrounded by an annular tile 22. A fuel orifice 11, which may be located within a gas spud 24, is located at upstream end 16 and introduces fuel gas into burner tube 12. Fresh or ambient air is introduced into primary air chamber 26 through adjustable damper 28 to mix with the fuel gas at upstream end 16 of burner tube 12. Combustion of the fuel gas and fresh air occurs downstream of burner tip 20.

A plurality of air ports 30 originates in secondary air chamber 32 and pass through furnace floor 14 into the furnace. Fresh air enters secondary air chamber 32 through adjustable dampers 34 and passes through staged air ports 30 into the furnace to provide secondary or staged combustion, as described in U.S. Pat. No. 4,629,413.

Figure 2:
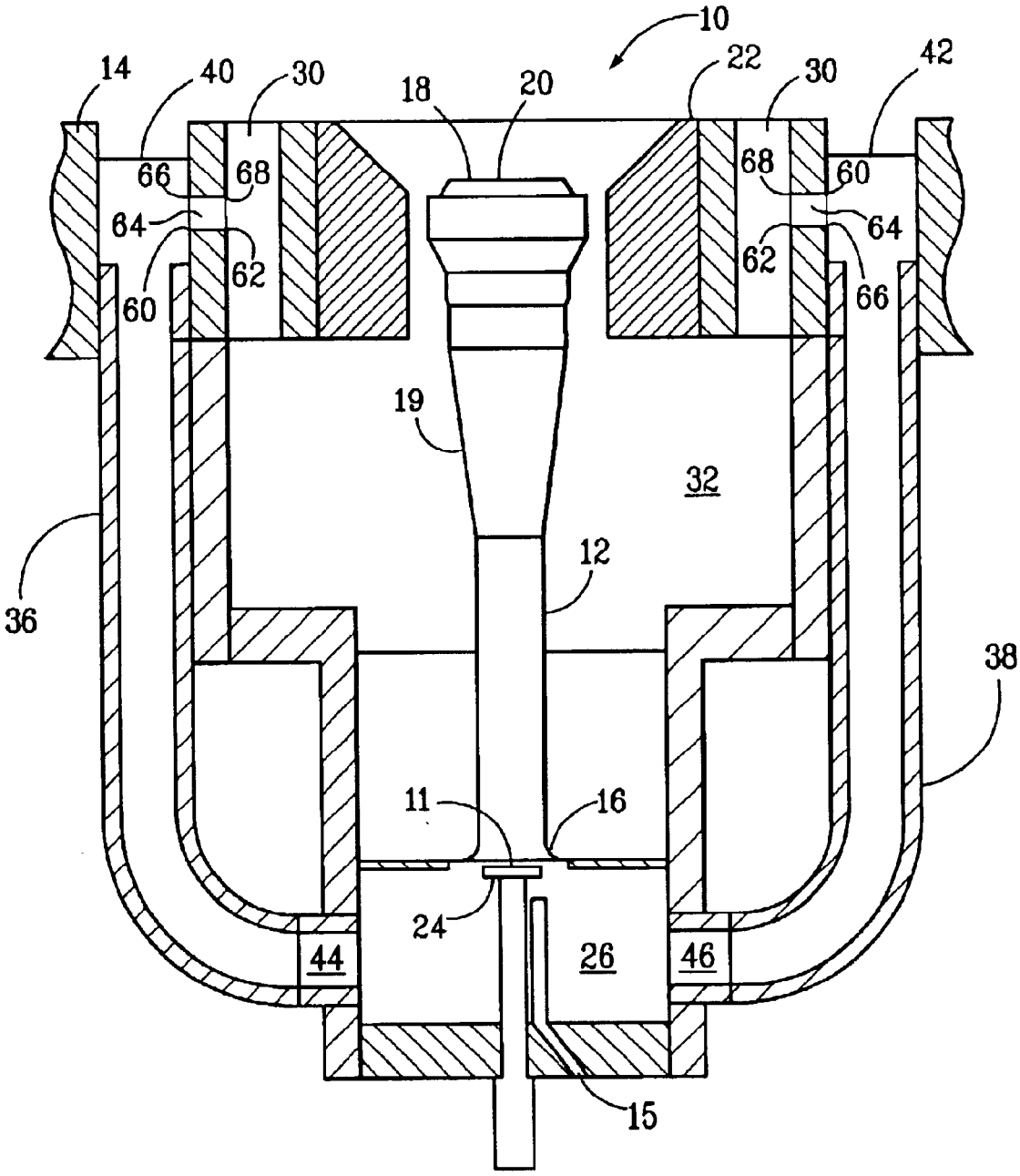
FIG. 2 is an elevation partly in section taken along line 2—2 of FIG. 1.
Figure 3:
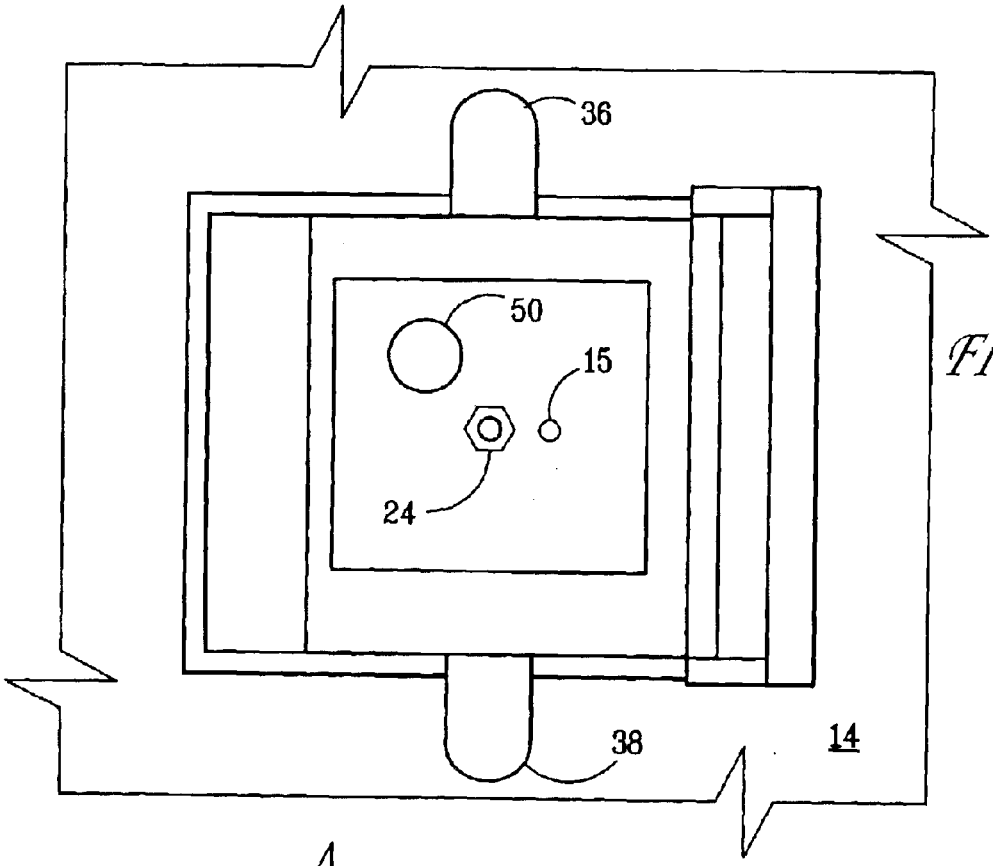
FIG. 3 is a plan view taken along line 3—3 of FIG. 1.
Figure 4:
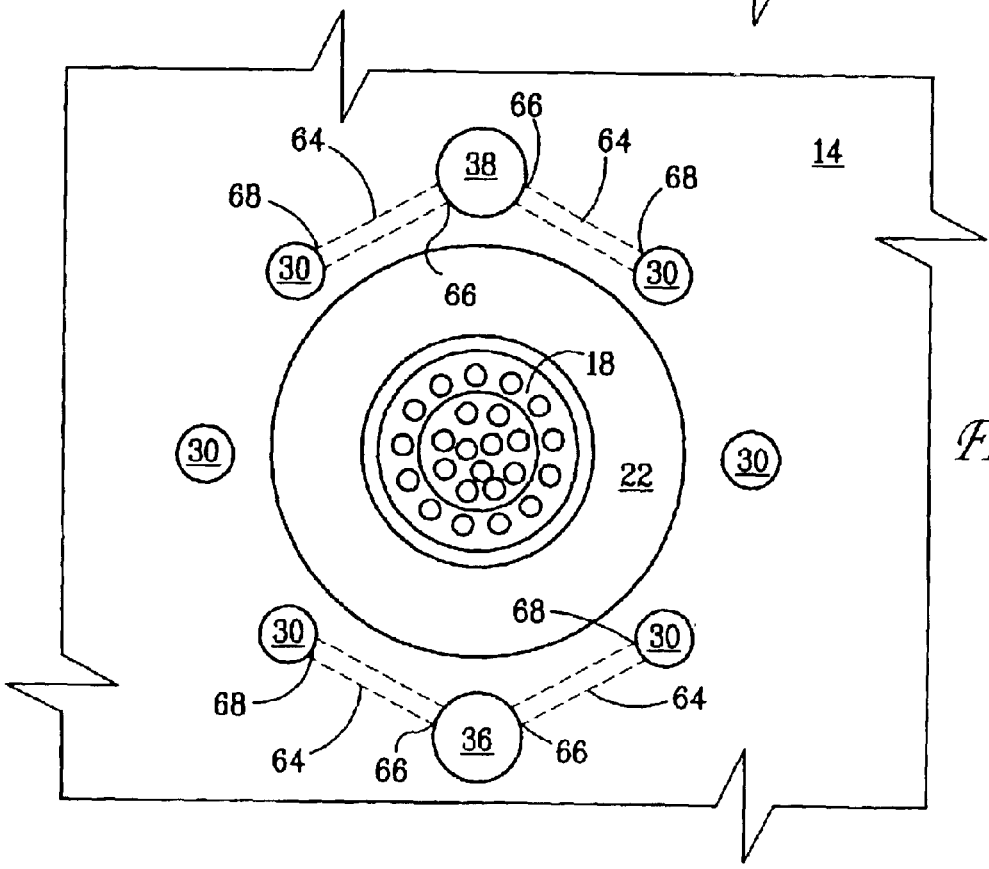
FIG. 4 is a plan view taken along line 4—4 of FIG. 1.

In order to recirculate flue gas from the furnace to the primary air chamber, ducts or pipes 36, 38 extend from openings 40, 42, respectively, in the floor of the furnace to openings 44, 46, respectively, in burner 10. Pipes 36 and 38 are preferably formed from metal and are inserted in openings 40 and 42 so as to extend only partially therethrough and not directly meet with the interior surface of the furnace as shown in FIG. 2. This configuration avoids direct contact with and radiation from the very high gas temperatures at openings 40 and 42.

Flue gas containing, for example, 0 to about 15% $O_2$ is drawn through pipes 36, 38, with about 5 to about 15% $O_2$ preferred, about 2 to about 10% $O_2$ more preferred and about 2 to about 5% $O_2$ particularly preferred, by the inspirating effect of fuel gas passing through venturi portion 19 of burner tube 12. In this manner, air and flue gas are mixed in primary air chamber 26, which is prior to the zone of combustion. Therefore, the inert material mixed with the fuel reduces the flame temperature and, as a result, reduces $NO_x$ emissions.

Closing or partially closing damper 28 restricts the amount of fresh air that can be drawn into the primary air chamber 26 and thereby provides the vacuum necessary to draw flue gas from the furnace floor.

Unmixed low temperature ambient air, having entered secondary air chamber 32 through dampers 34 is drawn from air port 30 through orifice 62, through bleed air duct 64, through orifice 60 into pipes 36, 38 into the primary air chamber by the inspirating effect of the fuel gas passing through venturi portion 19. The ambient air may be fresh air as discussed above. The mixing of the cool ambient air with the flue gas lowers the temperature of the hot flue gas flowing through pipes 36, 38 and thereby substantially increases the life of the pipes 36 and 38 and allows use of this type of burner to reduce $NO_x$ emission in high temperature cracking furnaces having flue gas temperature above 1900° F. in the radiant section of the furnace. Bleed air duct 64 has a first end 66 and a second end 68, first end 66 connected to orifice 60 of pipe 36 or 38 and second end 68 connected to orifice 62 of air port 30.

Additionally, a minor amount of unmixed low temperature ambient air, relative to that amount passing through duct 64, having passed through air ports 30 into the furnace, may also be drawn through pipes 36, 38 into the primary air chamber by the inspirating effect of the fuel gas passing through venturi portion 19. To the extent that damper 28 is completely closed, bleed air duct 64 should be sized so as to permit the necessary flow of the full requirement of primary air needed by burner 10.

Advantageously, a mixture of from about 20% to about 80% flue gas and from about 20% to about 80% ambient air should be drawn through pipes 36, 38. It is particularly preferred that a mixture of about 50% flue gas and about 50% ambient air be employed. The desired proportions of flue gas and ambient air may be achieved by proper sizing, placement and/or design of pipes 36, 38, bleed air ducts 64 and air ports 30, as those skilled in the art will readily recognize. That is, the geometry and location of the air ports and bleed air ducts may be varied to obtain the desired percentages of flue gas and ambient air.

A sight and lighting port 50 is provided in the burner 10, both to allow inspection of the interior of the burner assembly, and to provide access for lighting of the burner. The burner plenum may be covered with mineral wool and wire mesh screening 54 to serve as insulation.

Figure 5:
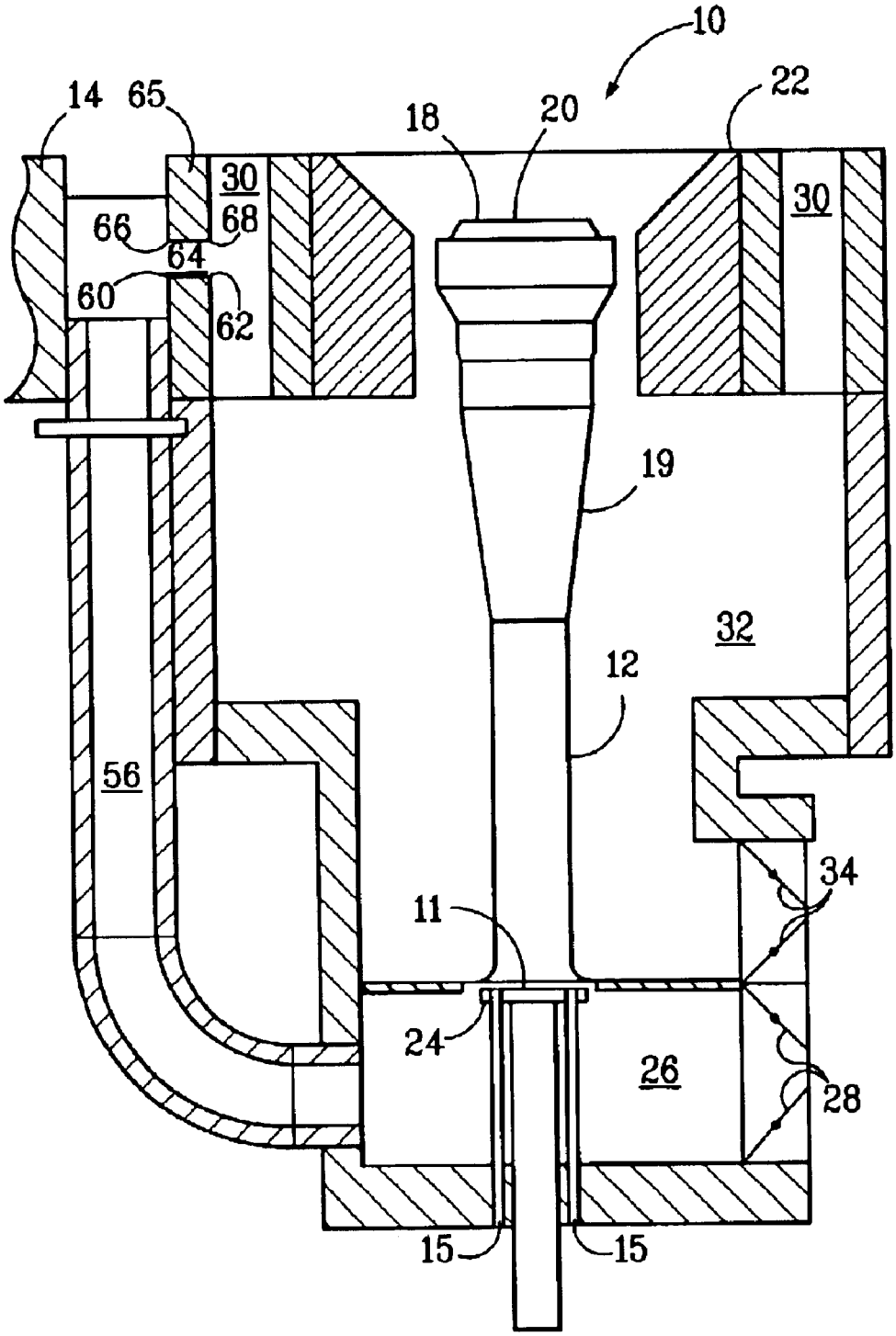
FIG. 5 is a second embodiment of the premix burner of the present invention.
Figure 6:
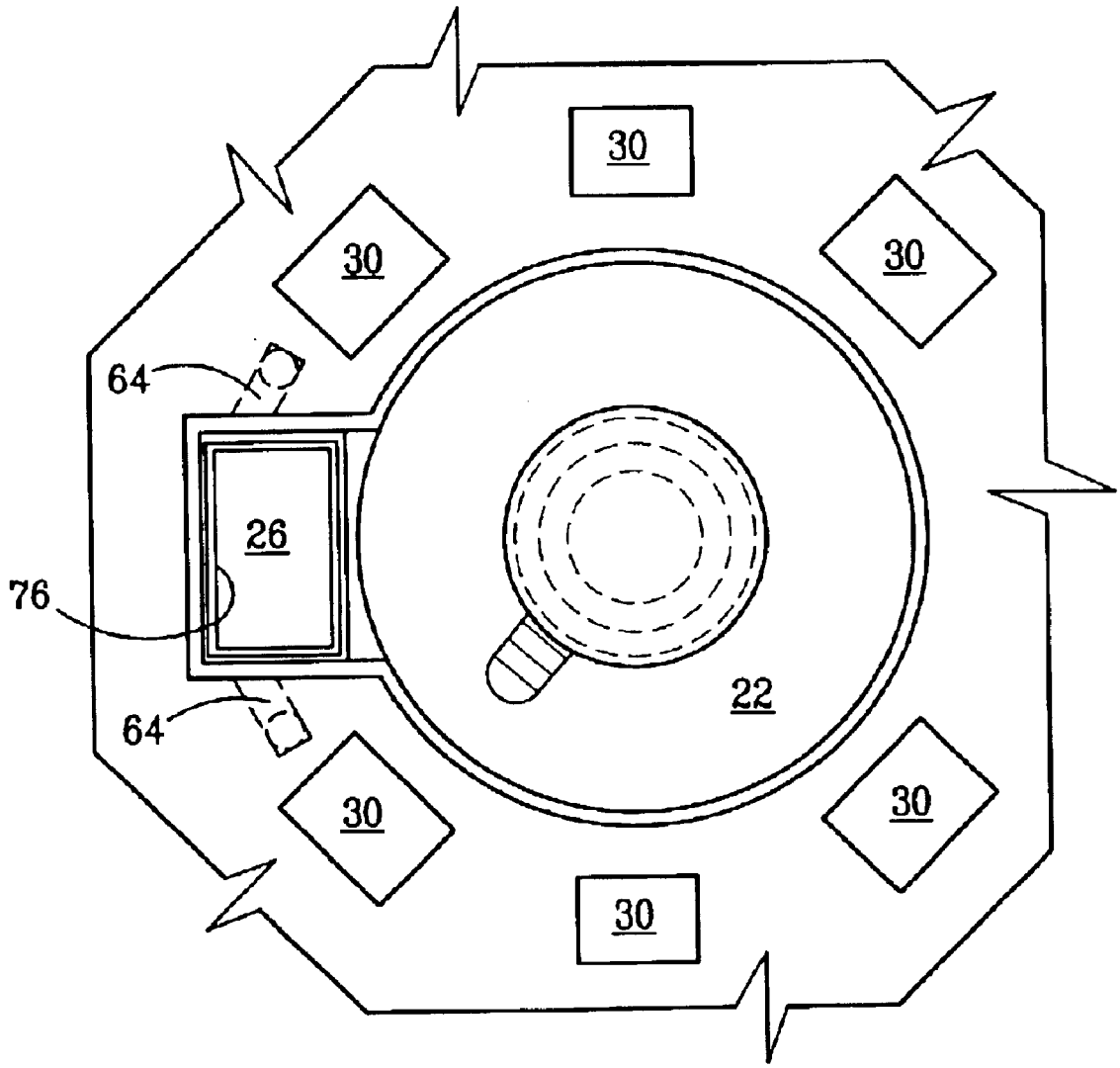
FIG. 6 is a plan view taken along line 6—6 of FIG. 7.
Figure 7:
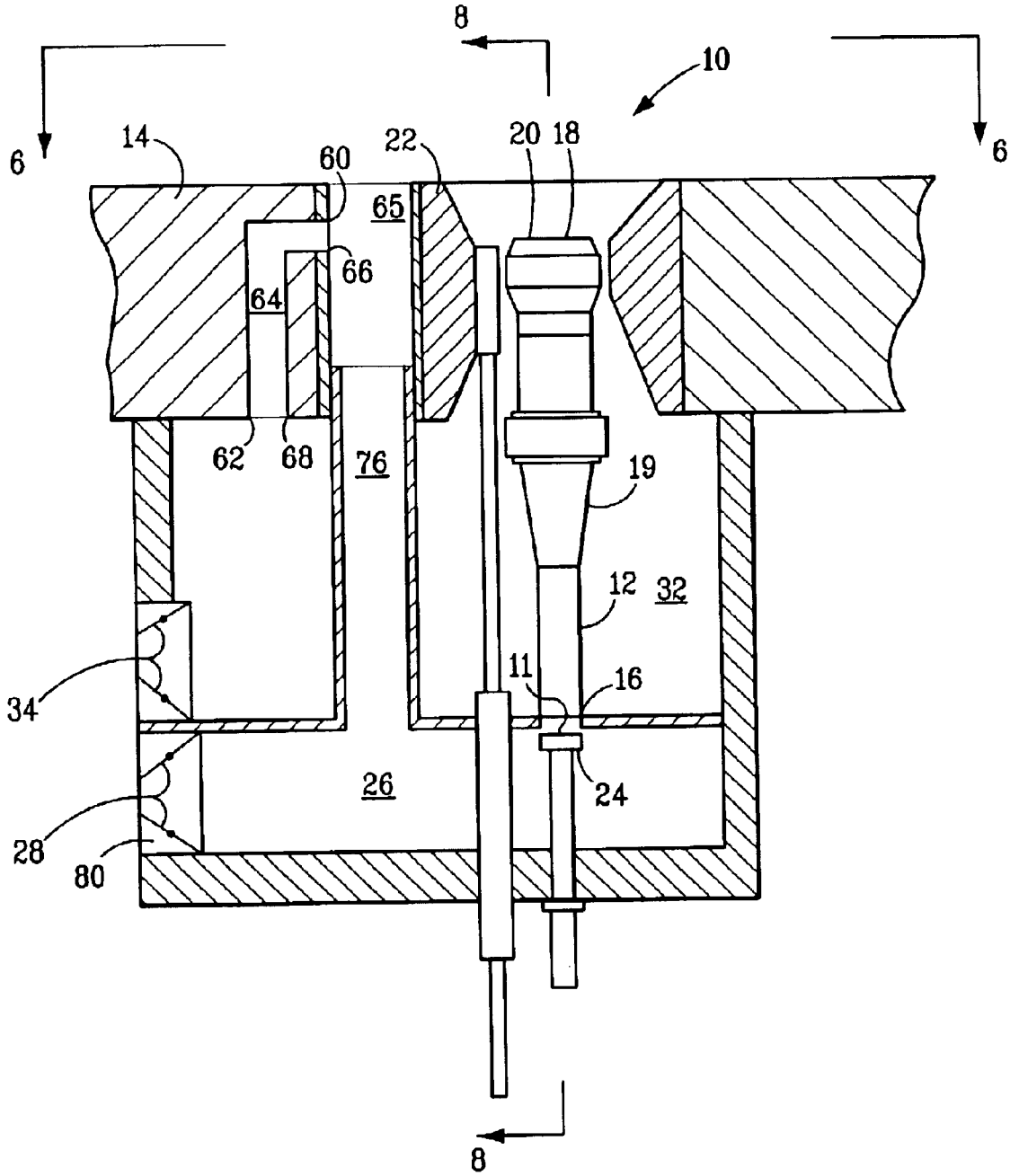
FIG. 7 is an elevation partly in section of a third embodiment of the premix burner of the present invention.
Figure 8:
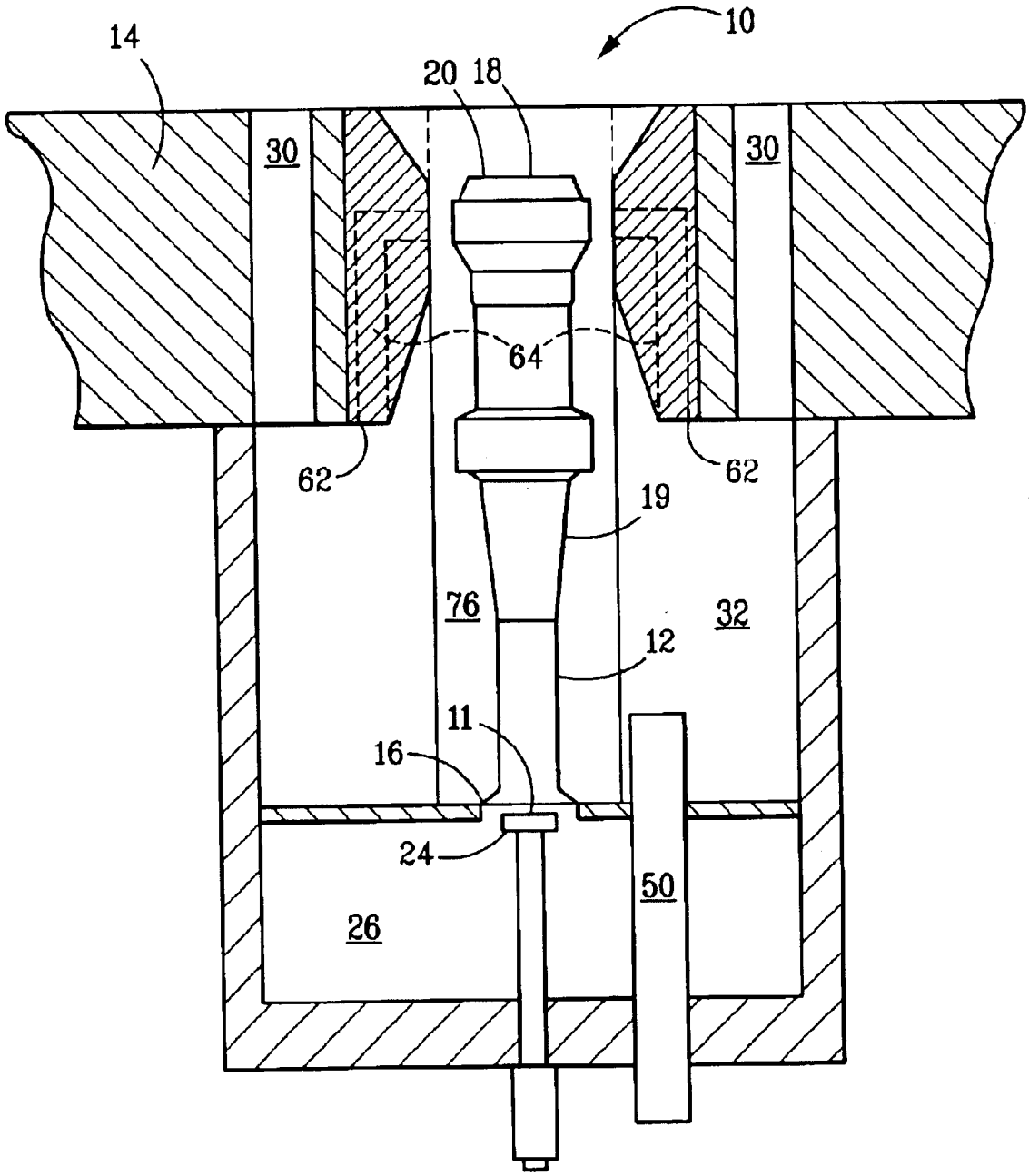
FIG. 8 is an elevation partly in section taken along line 8—8 of FIG. 7.

An alternate embodiment to the premix burner of FIGS. 1–4 is shown in FIG. 5, wherein like reference numbers indicate like parts. As may be seen, the main difference between the embodiment of FIGS. 1–4, and that of FIG. 5, is that the latter employs only a single recirculation pipe 56. In this embodiment, for example, a single 6-inch diameter pipe is used to replace two 4-inch diameter pipes. Once again, the desired proportions of flue gas and ambient air may be achieved by the proper sizing, placement and/or design of pipe 56, bleed air duct 64 and air ports 30. In this embodiment, furnace floor 14, comprised of a high temperature, low thermal conductivity material, which may, for example, be selected from ceramics, ceramic fibers or castable refractory materials, includes a wall portion 65 having an air bleed duct 64 formed through the wall portion 65 of the furnace floor 14. In this configuration, the temperature of the metallic recirculation pipe 56 is minimized.

The improved flue gas recirculating system of the present invention may also be used in a low $NO_x$ burner design of the type illustrated in FIGS. 6, 6A, 7 and 8, wherein like reference numbers indicate like parts. As with the embodiment of FIGS. 1–4, a premix burner 10 includes a freestanding burner tube 12 located in a well in a furnace floor 14. Burner tube 12 includes an upstream end 16, a downstream end 18 and a venturi portion 19. Burner tip 20 is located at downstream end 18 and is surrounded by an annular tile 22. A fuel orifice 11, which may be located within gas spud 24, is located at upstream end 16 and introduces fuel gas into burner tube 12. Fresh or ambient air is introduced into primary air chamber 26 through adjustable damper 28 to mix with the fuel gas at upstream end 16 of burner tube 12. Combustion of the fuel gas and fresh air occurs downstream of burner tip 20.

A plurality of air ports 30 originate in secondary air chamber 32 and pass through furnace floor 14 into the furnace. Fresh air enters secondary air chamber 32 through adjustable dampers 34 and passes through staged air ports 30 into the furnace to provide secondary or staged combustion.

In order to recirculate flue gas from the furnace to the primary air chamber, a flue gas recirculation passageway 76 is formed in furnace floor 14 and extends to primary air chamber 26, so that flue gas is mixed with fresh air drawn into the primary air chamber from opening 80. Flue gas containing, for example, 0 to about 15% $O_2$ is drawn through passageway 76, with about 5 to about 15% $O_2$ preferred, about 2 to about 10% $O_2$ more preferred and about 2 to about 5% $O_2$ particularly preferred, by the inspirating effect of fuel gas passing through venturi portion 19 of burner tube 12. As with the embodiment of FIGS. 1–4, the primary air and flue gas are mixed in primary air chamber 26, which is prior to the zone of combustion. Closing or partially closing damper 28 restricts the amount of fresh air that can be drawn into the primary air chamber 26 and thereby provides the vacuum necessary to draw flue gas from the furnace floor.

Unmixed low temperature ambient air, having entered secondary air chamber 32 through dampers 34 is drawn from secondary chamber 32 through orifice 62, through bleed air duct 64, through orifice 60 into flue gas recirculation passageway 76 into the primary air chamber 26 by the inspirating effect of the fuel gas passing through venturi portion 19. Again, the ambient air may be fresh air, as discussed above. Bleed air duct 64 has a first end 66 and a second end 68, first end 66 connected to orifice 60 of flue gas recirculation passageway 76 and second end 68 connected to orifice 62 and in fluid communication with secondary chamber 32. As with the embodiment of FIG. 5, furnace floor 14 comprises a high temperature, low thermal conductivity material, and includes a wall portion 65 having an air bleed duct 64 formed through the wall portion 65 of the furnace floor 14 to minimize the temperature of the metallic flue gas recirculation passageway 76.

Additionally, a minor amount of unmixed low temperature ambient air, relative to that amount passing through duct 64, having passed through air ports 30 into the furnace, may also be drawn through flue gas recirculation passageway 76 into the primary air chamber 26 by the inspirating effect of the fuel gas passing through venturi portion 19.

As with the embodiments of FIGS. 1–4 and 5, a mixture of from about 20% to about 80% flue gas and from about 20% to about 80% ambient air should be drawn through passageway 76. It is particularly preferred that a mixture of about 50% flue gas and about 50% ambient air be employed. The desired proportions of flue gas and ambient air may be achieved by proper sizing, placement and/or design of flue gas recirculation passageway 76, bleed air ducts 64 and air ports 30; that is, the geometry and location of the air ports and bleed air ducts may be varied to obtain the desired percentages of flue gas and ambient air.

Sight and lighting port 50 provides access to the interior of burner 10 for lighting element (not shown).

A similar benefit can be achieved simply by providing a hole or holes in the FGR duct as it passes through the staged-air plenum or chamber. Such a feature can be employed in flat-flame burners, as will now be described by reference to FIGS. 9 and 10. A burner 110 includes a freestanding burner tube 112 located in a well in a furnace floor 114. Burner tube 112 includes an upstream end 116, a downstream end 118 and a venturi portion 119. Burner tip 120 is located at downstream end 118 and is surrounded by an annular tile 122. A fuel orifice 111, which may be located within gas spud 124, is located at upstream end 116 and introduces fuel gas into burner tube 112. Fresh or ambient air is introduced into primary air chamber 126 to mix with the fuel gas at upstream end 116 of burner tube 112. Combustion of the fuel gas and fresh air occurs downstream of burner tip 120. Fresh secondary air enters secondary chamber 132 through dampers 134.

In order to recirculate flue gas from the furnace to the primary air chamber, a flue gas recirculation passageway 176 is formed in furnace floor 114 and extends to primary air chamber 126, so that flue gas is mixed with fresh air drawn into the primary air chamber from opening 180 through dampers 128. Flue gas containing, for example, 0 to about 15% $O_2$ is drawn through passageway 176 by the inspirating effect of fuel gas passing through venturi portion 119 of burner tube 112. Primary air and flue gas are mixed in primary air chamber 126, which is prior to the zone of combustion.

Unmixed low temperature ambient air, having entered secondary air chamber 132 through dampers 134 is drawn from secondary air chamber 132 through orifice 162, through at least one bleed air duct 164, through orifice 160 into flue gas recirculation passageway 176 into the primary air chamber 126 by the inspirating effect of the fuel passing through venturi portion 119. The ambient air may be fresh air as discussed above. Each bleed air duct 164 has a first end 166 and a second end 168, first end 166 connected to orifice 160 of flue gas recirculation passageway 176 and second end 168 connected to orifice 162 and in fluid communication with secondary air chamber 132. As is preferred, furnace floor 114 comprises a high temperature, low thermal conductivity material and includes at least a portion of air bleed duct 164 formed within furnace floor 114 to minimize the temperature of the flue gas recirculation passageway 176.

Once again, it is desirable that a mixture of from about 20% to about 80% flue gas and from about 20% to about 80% ambient air should be drawn through passageway 176. It is particularly preferred that a mixture of about 50% flue gas and about 50% ambient air be employed. The desired proportions of flue gas and ambient air may be achieved by proper sizing and placement of passageway 176 and bleed air ducts 164. Additionally, a plurality of bleed ducts 164 may be employed to obtain the desired percentages of flue gas and ambient air.

In operation, the mixture in the venturi portion 119 of burner tube 112 is maintained below the fuel-rich flammability limit; i.e. there is insufficient air in the venturi to support combustion. Secondary air is added to provide the remainder of the air required for combustion. The majority of the secondary air is added a finite distance away from the burner tip 120.

As may be appreciated, a feature of the burner of the present invention is that the flue-gas recirculated to the burner is mixed with a portion of the cool staged air in the FGR duct. This mixing reduces the temperature of the stream flowing in the FGR duct, and enables readily available materials to be used for the construction of the burner. This feature is particularly important for the burners of high temperature furnaces such as steam crackers or reformers, where the temperature of the flue-gas being recirculated can be as high as 1900° F.-2100° F. By combining approximately one pound of staged-air with each pound of flue-gas recirculated, the temperature within the FGR duct can be advantageously reduced.

It may be recognized that prior flat flame burner designs have employed the use of one or more holes placed in the metal portion of an FGR duct, within the secondary air chamber, in an attempt to reduce the overall temperature of the flue gas. While of some benefit, such a design has only a minimal effect on duct life and temperature reduction, since the cooler secondary air enters the FGR duct after the metal portion has been exposed to hot flue gas before any significant mixing with secondary air can take place. As may be appreciated by those skilled in the art, the flat flame burner design of the present invention overcomes these shortcomings.

Unlike prior designs, one or more passageways connecting the secondary air chamber directly to the flue-gas recirculation duct induce a small quantity of low temperature secondary air into the FGR duct to cool the air/flue-gas stream entering in the metallic section of the FGR duct. By having the majority of the secondary air supplied directly from the secondary air chamber, rather than having the bulk of the secondary air traverse across the furnace floor prior to entering the FGR duct, beneficial results are obtained, as demonstrated by the Examples below.

EXAMPLES

To assess the benefits of the present invention, an energy and material balance was performed for each of the configurations described below.

Example 1

In order to demonstrate the benefits of the present invention, the operation of a pre-mix burner employing flue gas recirculation of the type described in U.S. Pat. No. 5,092,761 (as depicted in FIG. 5 of U.S. Pat. No. 5,092,761), was calculated using data from existing burner designs to set the energy and material balance. Results of the detailed material and energy balance are illustrated in Table 1 for the baseline burner of Example 1.

Example 2

In Example 2, the same material balance is maintained as in the existing burner. As indicated in Table 1, the detailed material and energy balance calculated was calculated to be reduced by over 100° F. Note that the momentum ratio of the venturi (momentum of fuel jet in:momentum of air/fuel/flue-gas stream after mixing) is reduced, indicating that the load on the venturi mixer has been reduced.

TABLE 1

| Case | Example 1 | Example 2 |
|---|---|---|
| FGR Ratio* | 8.5% | 8.5% |
| Mass ratio air: flue-gas in FGR duct | 1.0 | 1.0 |
| Temp of air entering FGR duct | 700° F. | 60° F. |
| Temperature in FGR duct | 1361° F. | 1073° F. |
| $O_2$ in FGR duct (dry vol. %) | 12.4 | 12.4 |
| Mass ratio Primary air: Total FGR duct flow | 0.5 | 0.5 |
| Temperature in Venturi | 633° F. | 506° F. |
| $O_2$ in Venturi (dry vol. %) | 10.8 | 10.8 |

*FGR Ratio (pct.) = 100 × mass flow of flue-gas recycled/(fuel mass flow + combustion air mass flow)

As may be appreciated by those skilled in the art, the present invention can be incorporated in new burners or can be retrofitted into existing burners by alterations to the burner surround.

Figure 9:
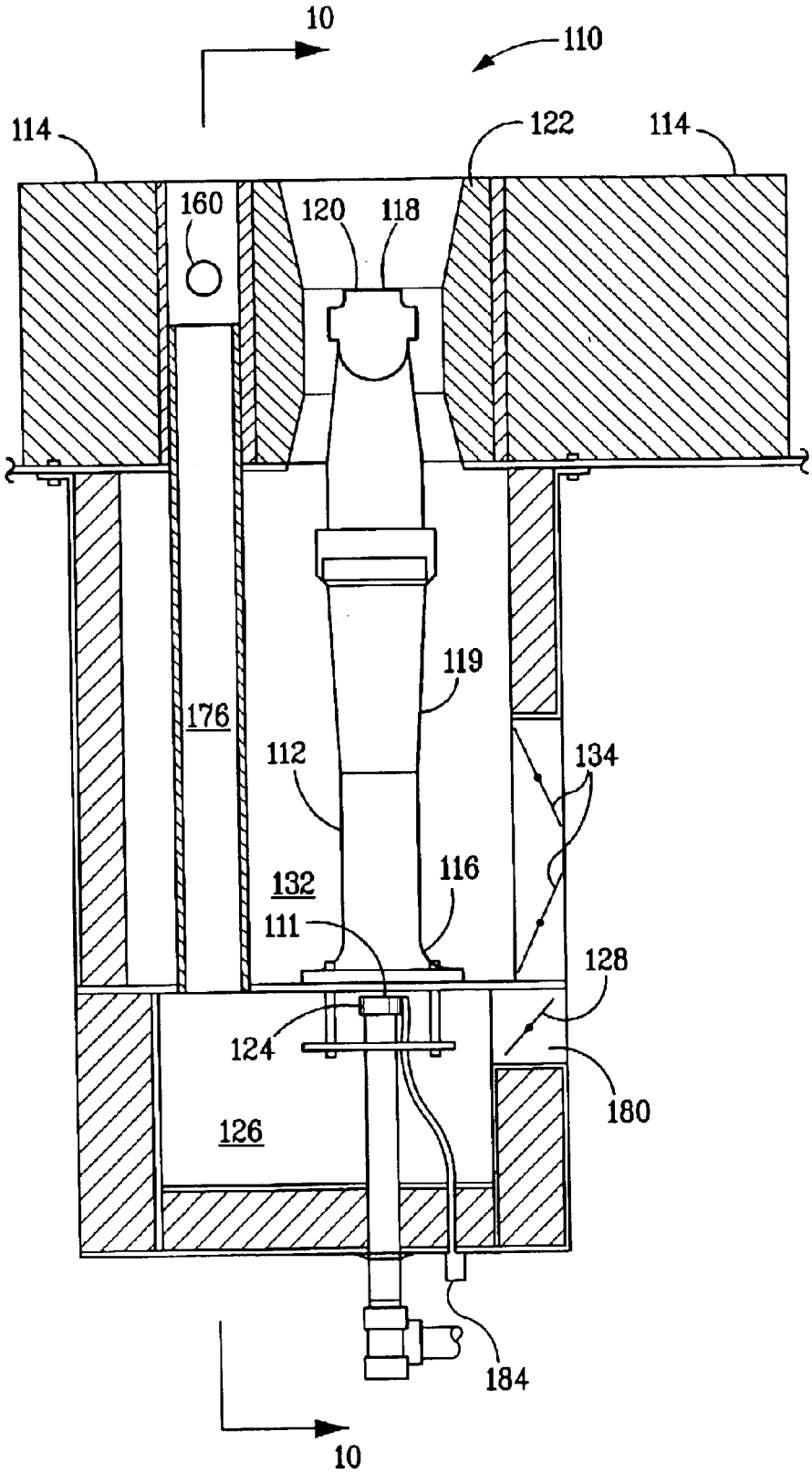
FIG. 9 illustrates an elevation partly in section of an embodiment of a flat-flame burner of the present invention.
Figure 10:
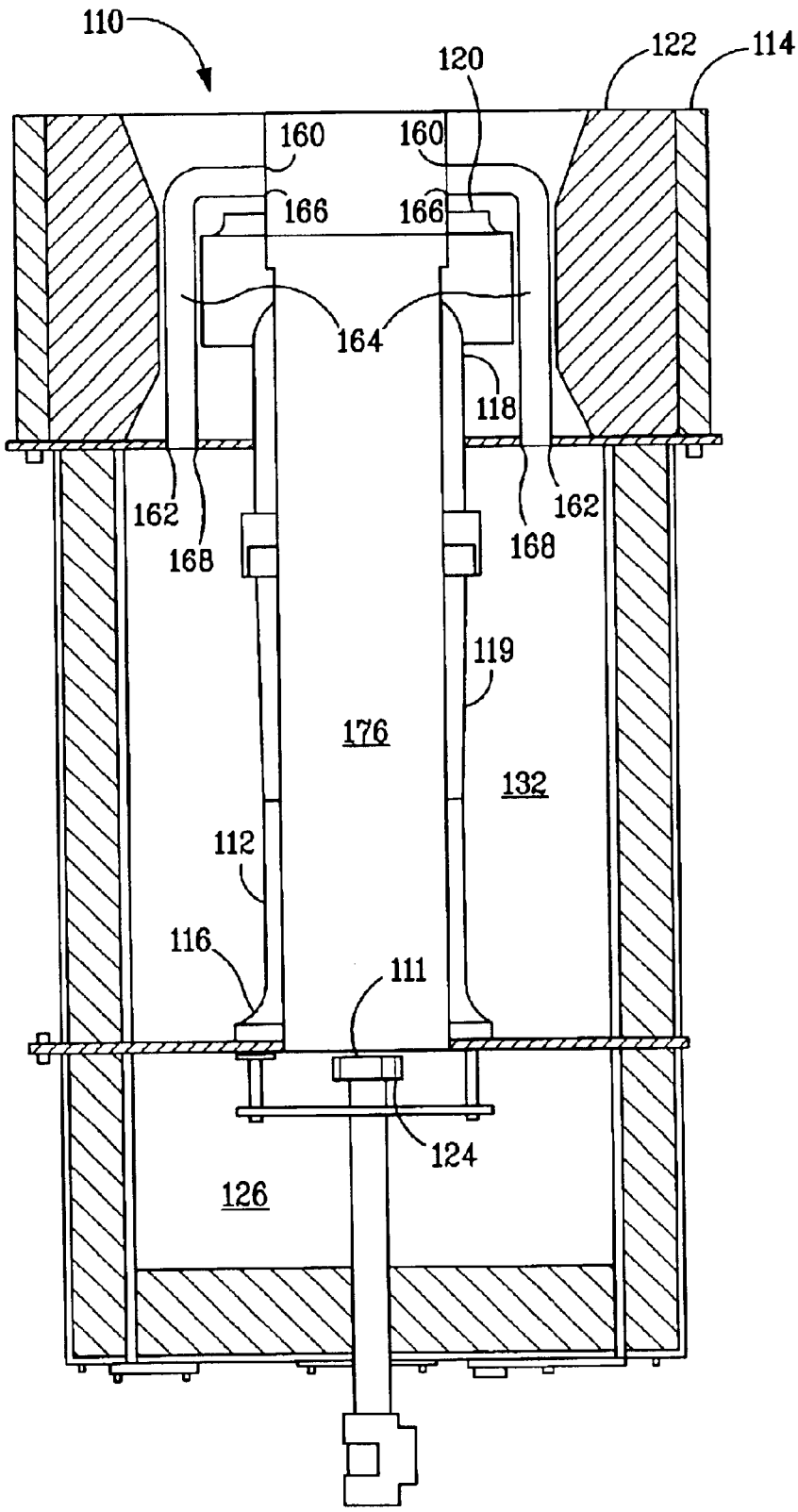
FIG. 10 is an elevation partly in section of the embodiment of a flat-flame burner of FIG. 9 taken along line 10—10 of FIG. 9.

In addition to the use of flue gas as a diluent, another technique to achieve lower flame temperature through dilution is through the use of steam injection. Steam can be injected in the primary air or the secondary air chamber. Steam injection may occur through, for example, steam injection tube 15, as shown in FIG. 2, or steam injection tube 184, as shown in FIG. 9. Preferably, steam may be injected upstream of the venturi.

Although illustrative embodiments have been shown and described, a wide range of modification, change and substitution is contemplated in the foregoing disclosure and in some instances, some features of the embodiment may be employed without a corresponding use of other features. Accordingly, it is appropriate that the appended claims be construed broadly and in a manner consistent with the scope of the embodiments disclosed herein.

What is claimed is:

1. A burner for the combustion of fuel in a furnace, said burner comprising:

(a) a burner tube having a downstream end, and having an upstream end for receiving air and fuel;

(b) a burner tip being mounted on the downstream end of said burner tube adjacent to a first opening in the furnace, so that combustion of the fuel takes place downstream of said burner tip;

(c) at least one passageway having a first end at a second opening in the furnace and a second end adjacent the upstream end of said burner tube, said passageway having an orifice;

(d) at least one bleed air duct having a first end and a second end, said first end in fluid communication with said orifice of said at least one passageway and said second end in fluid communication with a source of air which is cooler than the flue gas; and (e) means for drawing flue gas from said furnace through said at least one passageway and air from said at least one bleed air duct through said at least one passageway in response to an inspirating effect created by uncombusted fuel flowing through said burner tube from its upstream end towards its downstream end, whereby the flue gas is mixed with air from said at least one air bleed duct prior to the zone of combustion of the fuel to thereby lower the temperature of the drawn flue gas.

2. The burner according to claim 1, wherein said means for drawing flue gas from said furnace comprises a venturi portion in said burner tube.

3. The burner according to claim 1, wherein said at least one air bleed duct is sized to permit the flow of all primary air required by the burner.

4. The burner according to claim 1, wherein the at least one passageway comprises a metal portion extending into and meeting with a non-metal portion and wherein said first end of said at least one bleed air duct is in fluid communication with the metal portion of said at least one passageway.

5. The burner according to claim 1, wherein the interior of said at least one passageway comprises a metal portion extending into and meeting with a non-metal portion and wherein said first end of said at least one bleed air duct is in fluid communication with the non-metal portion of said at least one passageway.

6. The burner according to claim 1, further comprising a secondary air chamber, wherein said first end of said at least one passageway is in fluid communication with said secondary air chamber.

7. The burner according to claim 1, further comprising a secondary air chamber and at least one air port, wherein said first end of said at least one passageway is in fluid communication with said at least one air port, said at least one air port having a first end at a third opening in said furnace and a second end in fluid communication with said secondary air chamber.

8. The burner according to claim 1, further comprising a primary air chamber, wherein said at least one passageway comprises a duct having a first end and a second end, said first end extending into a second opening in the furnace, and said second end extending into said primary air chamber.

9. The burner according to claim 2, further comprising a primary air chamber, comprising at least one adjustable damper opening into said primary air chamber to restrict the amount of ambient air entering into said primary air chamber, thereby providing a vacuum to draw flue gas from the furnace.

10. The burner according to claim 3, further comprising a ceramic furnace floor, wherein said air bleed duct is formed through said ceramic furnace floor.

11. The burner according to claim 9, further comprising a ceramic furnace floor having a wall portion thereof, wherein said air bleed duct is formed through said wall portion of said ceramic furnace floor.

12. The burner according to claim 11, wherein the fuel is fuel gas and the burner is a premix burner.

13. The burner according to claim 1, wherein the fuel is fuel gas and the burner is a premix burner.

14. The burner according to claim 1, wherein the fuel is fuel gas and the burner is a flat-flame burner.

15. The burner according to claim 1, further comprising at least one steam injection tube for injecting steam upstream of said burner tube.

16. A method for operating a burner of a furnace, comprising the steps of:

(a) combining fuel, air and flue gas at a predetermined location;

(b) combusting the fuel at a combustion zone downstream of said predetermined location;

(c) drawing a stream of flue gas from the furnace in response to the inspirating effect of uncombusted fuel flowing towards said combustion zone; and (d) mixing air drawn from a duct, the air having a temperature lower than the temperature of the flue gas, with the stream of flue gas drawn in step (c) and drawing the mixture of the lower temperature air and flue gas, to said predetermined location, to thereby lower the temperature of the drawn flue gas.

17. The method of claim 16, wherein said drawing step includes passing the fuel, air and flue gas through a venturi, whereby the inspirating effect of the uncombusted fuel exiting a fuel orifice and flowing through said venturi draws the flue gas and lower temperature air through said duct.

18. The method of claim 17, wherein the fuel is fuel gas and the burner is a premix burner.

19. The method of claim 16, wherein the fuel is fuel gas and the burner is a premix burner.

20. The method of claim 17, wherein the fuel is fuel gas and the burner is a flat-flame burner.

21. The method of claim 16, wherein the fuel is fuel gas and the burner is a flat-flame burner.

22. The method according to claim 21 wherein the furnace is a steam cracking furnace.

23. The method according to claim 20 wherein the furnace is a steam cracking furnace.

24. The method according to claim 19 wherein the furnace is a steam cracking furnace.

25. The method according to claim 18 wherein the furnace is a steam cracking furnace.

26. The method according to claim 17 wherein the furnace is a steam cracking furnace.

27. The method according to claim 16, further comprising the step of injecting steam upstream of the burner tube.

* * * * *